US005803819A

United States Patent [19]

Tuten et al.

[11] Patent Number: 5,803,819

[45] Date of Patent: Sep. 8, 1998

[54] SOLID STATE PINSPOTTER CONTROLLED CHASSIS AND METHOD THEREFOR

[76] Inventors: William J. Tuten, 8708 E. Malcomb Dr., Scottsdale, Ariz. 85253; Kennith D. Crosby, 10199 E. Sweetwater, Scottsdale, Ariz. 85260

[21] Appl. No.: 558,625

[22] Filed: Nov. 13, 1995

[51] Int. Cl.[6] ..... A63D 5/00

[52] U.S. Cl. ..... 473/65; 473/66; 473/102

[58] Field of Search ..... 473/54, 64, 65, 473/66, 67, 69, 70, 71, 72, 73, 101, 102, 103; 364/410, 411; 340/323 B

[56] References Cited

U.S. PATENT DOCUMENTS

| | | | |
|---|---|---|---|
| Re. 28,503 | 8/1975 | Townsend et al. | 473/70 |
| 3,239,222 | 3/1966 | Sanders et al. | 473/65 |
| 3,240,493 | 3/1966 | Cohn | 473/66 |
| 3,610,619 | 10/1971 | Matcovich et al. | 473/69 |
| 3,795,402 | 3/1974 | Bolger, Jr. et al. | 473/101 |
| 3,804,408 | 4/1974 | Saito et al. | 473/101 |
| 3,847,394 | 11/1974 | Logemann, Jr. et al. | 473/101 |
| 4,133,042 | 1/1979 | Wallace | 473/65 |
| 4,140,314 | 2/1979 | Kaenel | 473/101 |
| 4,148,480 | 4/1979 | Smith-Vaniz et al. | 473/101 |
| 4,148,481 | 4/1979 | Smith-Vaniz | 473/101 |
| 4,151,993 | 5/1979 | Payne et al. | 473/66 |
| 4,350,337 | 9/1982 | Knauer et al. | 473/66 |
| 4,592,548 | 6/1986 | Oldson | 473/66 |
| 4,724,506 | 2/1988 | Isawa | 473/66 |
| 4,726,587 | 2/1988 | Fitch | 473/101 |
| 4,827,412 | 5/1989 | Form | 473/101 |
| 5,115,125 | 5/1992 | Biggs | 473/101 |
| 5,437,576 | 8/1995 | Tuten et al. | 473/101 |

*Primary Examiner*—Jessica Harrison
*Assistant Examiner*—Mark A. Sager
*Attorney, Agent, or Firm*—Harry M. Weiss; Jeffrey D. Moy; Harry M. Weiss & Associates, P.C.

[57] ABSTRACT

The present invention is an all solid state chassis for controlling a bowling pin pinspotter. The solid state chassis is designed to replace current electromechanical chassis such as the AMF 8270 chassis, while providing new and unique capability in diagnostics and communication. The solid state chassis is designed to reduce the energy consumption of the pinspotter. The solid state chassis is also designed to detect and provide self protection against faults and overloads. The solid state chassis also allows for remote communication with the pinspotter via a hardwired communication link or by electromagnetic means.

20 Claims, 12 Drawing Sheets

SOLID STATE PINSPOTTER CONTROLLED CHASSIS AND METHOD THEREFOR

BACKGROUND OF THE INVENTION

1. Field of the Invention

This invention relates generally to bowling systems and, more specifically, to a solid state pinspotter controlled chassis and method therefor which provides significant new features not currently available on present pinspotter controlled chassis.

2. Description of the Prior Art

The AMF 8270 pinspotter was designed sometime during the period between the late 1960's to the early 1970's. These pinspotters were designed to improve the performance of the existing 8230 pinspotters by improving reliability, providing enhanced functions currently not available in the 8230 pinspotters and by reducing the time it took to bowl a game. Three models of the 8270 pinspotters currently exist. Their model designations are A, B, and C with the C model being the model most widely used. The controller (i.e., the chassis) for the 8270 pinspotter was radically changed as compared to the 8230 chassis. Timing and logic functions were accomplished using multiple printed circuit boards in the early chassis and by a single printed circuit board in the later chassis. Relays, switches, breakers and a multiplicity of transformers were used in conjunction with the above mentioned electronics to control the motors, solenoids, etc.

While the 8270 chassis do work, there are several functional limitations to these types of chassis. Furthermore, the 8270 chassis was an electromechanical type of chassis. By replacing the electromechanical chassis with an all solid state chassis, reliability will improve and maintenance cost will decrease. An all solid state chassis will also conserve energy by reducing the amount of power required to operate the chassis.

There are solid state chassis currently available in the marketplace. See Tuten et al., U.S. Pat. No. 5,437,576, which discloses a solid state pinspotter control system. The present invention will perform the same functions as the Tuten et al. control system as well as provide significant new features and advantages. For example, the present invention is designed to replace the AMF 8270 chassis. Furthermore, the present invention will have a buffering mechanism which will prevent false operation of the microcontroller due to noise. The present invention will also have a communication module which will send and receive data to and from the solid state chassis from a remote location.

Therefore a need existed to provide an improved solid state chassis and method therefor for controlling a bowling pin pinspotter. The improved Chassis is a solid state chassis designed to replace the AMF 8270 chassis. It will prevent false operation of a microcontroller component of the chassis due to noise, allow data to be sent to and receive from the chassis from a remote location, as well as provide other advantages and features over current solid state chassis.

SUMMARY OF THE INVENTION

In accordance with one embodiment of the present invention, it is an object of the present invention to provide an improved solid state chassis and method therefor for controlling a bowling pin pinspotter.

It is another object of the present invention to provide an improved solid state chassis which will prevent false operation of a microcontroller component of the chassis due to noise.

It is still another object of the present invention to provide an improved solid state chassis that will allow data to be sent to and receive from the chassis from a remote location.

It is a further object of the present invention to provide an improved solid state chassis for use with at least an AMF 8270 pinspotter models A, B, and C.

BRIEF DESCRIPTION OF THE PREFERRED EMBODIMENT

In accordance with one embodiment of the present invention, a solid state chassis for controlling the operation of a bowling pin pinspotter is disclosed. The chassis comprises microcontroller means for controlling the operation of the chassis by receiving inputs from a plurality of elements coupled to the microcontroller and producing an output signal to control the chassis based on the inputs. Optical input means are coupled to the microcontroller means for buffering inputs to the microcontroller means to prevent noise associated with the plurality of elements from causing false outputs by the microcontroller means. Drive means are coupled to the microcontroller means for sending a signal to a pinspotter assembly that controls the spotting of bowling pins. Sweep means are coupled to the microcontroller means for sending a signal to a sweep type device that removes the bowling pins. Back end motor means are coupled to the microcontroller means for moving the bowling pins to a distributor mechanism after the sweep means have removed the bowling pins. The back end motor means further has a means for generating a breaking signal which conserves power by deactivating the back end motor means when the sweep means are not active and for reinitiating the back end motor means after a ball has been rolled down the bowling lane. Power supply/power down means are coupled to the microcontroller means and to the plurality of elements for providing power to the plurality of elements and for detecting and controlling the activity of the chassis during a power failure. The power supply/power down means also allows the microcontroller means to remember a current status and a current position of the chassis and the bowling pin pinspotter when a power failure occurs. The chassis may further comprise communication means coupled to the microcontroller means for sending and receiving data to and from the chassis from a remote location, fault protection means coupled to the microcontroller means for detecting excessive current use by the chassis and for protecting the solid state chassis from excessive current, option switch means coupled to the microcontroller means for allowing a selection of an operating cycle for the chassis, disabling means coupled to the microcontroller means for controlling power distribution to the chassis and the pinspotter assembly, and Brunswick interface means coupled to the microcontroller means for allowing the chassis to communicate with a Brunswick type scoring system.

In accordance with another embodiment of the present invention, a method for providing a solid state chassis is disclosed. The method comprises the steps of: providing microcontroller means for controlling the operation of the chassis by receiving inputs from a plurality of elements coupled to the microcontroller means and producing an output signal to control the chassis based on the inputs; providing optical input means coupled to the microcontroller means for buffering inputs to the microcontroller means to prevent noise associated with the plurality of elements from causing false outputs by the microcontroller means; providing drive means coupled to the microcontroller means for sending a signal to a pinspotter assembly that controls the spotting of bowling pins; providing sweep means coupled to the microcontroller means for sending a signal to a sweep type device that removes the bowling pins; providing back end motor means which are coupled to the microcontroller means for moving the bowling pins to a distributor mechanism after the sweep means have removed the bowling pins, the back end motor means further has a means for generating a breaking signal which conserves power by deactivating the back end motor means when the sweep means are not active and for reinitiating the back end motor means after a ball has been rolled down the bowling lane; and providing power supply/power down means coupled to the microcontroller means and the plurality of elements for providing power to the plurality of elements, for detecting and controlling the activity of the chassis during a power failure, and for allowing the microcontroller means to remember a current status and a current position of the solid state chassis and the pinspotter assembly when a power failure occurs.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
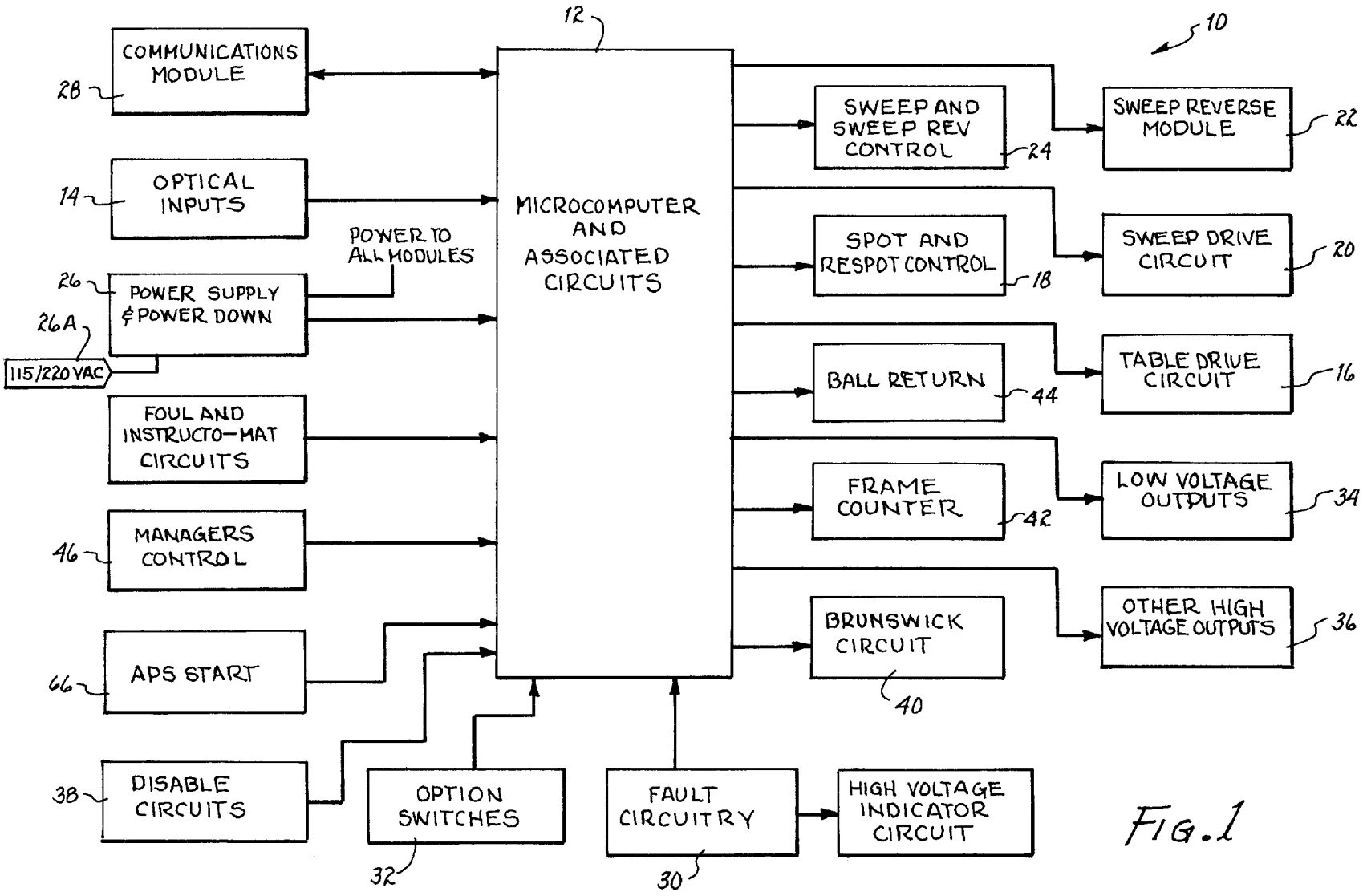
FIG. 1 is a simplified block diagram of the solid state chassis of the present invention.

Referring to FIG. 1, a solid state chassis (hereinafter chassis) 10 is shown. The chassis is comprised of a microcontroller 12. The microcontroller 12 is the heart of the chassis 10. The microcontroller 12 receives inputs from a plurality of modules which are coupled to the microcontroller 12. The microcontroller 12 reads these inputs from the plurality of modules and produces an output signal based on these inputs. Optical inputs 14 are coupled to the microcontroller 12. The optical inputs 14 buffer the inputs to the microcontroller 12 so that noise associated with the plurality of modules does not cause the false operation of the microcontroller 12.

A table drive circuit 16 is also coupled to the microcontroller 12. The table drive circuit 16 controls the spotting of the bowling pins by sending signals to a pinspotter assembly (not shown). The table drive circuit 16 operates in conjunction with the spot and respot controls 18 in order to place a set of bowling pins on the floor of the bowling lane.

A sweep drive circuit 20 is coupled to the microcontroller 12 for sending a signal to a sweep assembly (not shown) for removing the bowling pins from the floor of the bowling lane. The sweep drive circuit 20 works in conjunction with the sweep reverse module 22 and the sweep/sweep reverse control 24 in order to remove the fallen bowling pins from the floor after a first bowling ball is rolled, or to remove the remaining pins from the floor after a second bowling ball has been rolled. After the bowling pins have been removed from the floor, a back end motor 80 (FIG. 2), which is coupled to the microcontroller 12, moves the bowling pins to a distributor mechanism. The back end motor 80 has a circuit which generates a breaking signal which conserves power by deactivating the back end motor 80 when the sweep drive circuit 20 is not active and for reinitiating the back end motor 80 after a ball has been rolled down the bowling lane.

A power supply/power down circuit 26 is coupled to an outside power source 26A. The power supply/power down circuit 26 is used for supplying power to all of the plurality of elements which are coupled to the microcontroller 12. The power supply/power down circuit 26 also detects and controls the chassis 10 during a power failure. When a power failure does occur, the power supply/power down circuit 26 allows the microcontroller 12 to remember a current status and current position of the chassis 10 for the spotting of the bowling pins.

Option switches 32 are coupled to the microcontroller 12 for allowing an individual to select an operating cycle for the chassis 10. The operating option cycles include: no foul cycle, cycle from the manager's console, eliminate instructo-mat cycle, an eliminate manual intervention cycle, and a turn off back end motor due to inactivity cycle. The option switches 32 also includes selection switches on the chassis 10. The selection switches allow the sweep drive circuit 20 and the table drive circuit 16 to be operated directly from the chassis 10 even during lockout, provides a hard reset, and indicates the status of the chassis 10 using light emitting diodes. The selection switches include: sweep, table, start (cycle), and reset. When the sweep button is selected, the pinspotter will automatically sweep the pin deck clean. It will continue to sweep for as long as the sweep switch is selected. A similar action occurs when the table switch is selected. The start (cycle) switch will cause a ball indicator light to toggle from a first ball to a second ball status and vice versa. This toggle action sets the chassis 10 for the first ball or second ball cycle. The reset switch causes the chassis to be initialized no matter where the chassis 10 is in the cycle.

The chassis 10 is further comprised of a plurality of other different features. A communication circuit 28 is coupled to the microcontroller 12. The communication circuit 28 is used for sending and receiving data to and from the chassis 10 from a remote location. The transfer of data may be accomplished through a hardwired communication link or by electromagnetic means. A fault detection circuit 30 is coupled to the microcontroller 12 and is used for detecting and protecting the chassis 10 from excessive operating currents. The microcontroller 12 also has low voltage outputs 34 and high voltage outputs 36. The low voltage outputs 34 are used for controlling a plurality of status lights such as the pin indicators, normal, foul, strike, first ball, and second ball lights. The high voltage outputs 36 are used to control a plurality of motors for operating the pinspotter assembly. A disabling circuit 38 is coupled to the microcontroller 12 for controlling power distribution to the chassis 10 and the pinspotter assembly. Other features of the chassis 10 include a Brunswick interface 40 for allowing the chassis 10 to communicate with a Brunswick type scoring system, frame counter 42 for determining the current scoring frame of a bowler, ball return circuit 44 for sending a signal to return the bowling ball after the ball is rolled down the bowling lane, and a manager's control circuit 46 for allowing the manager to control the chassis from the manager's console.

Figure 2:
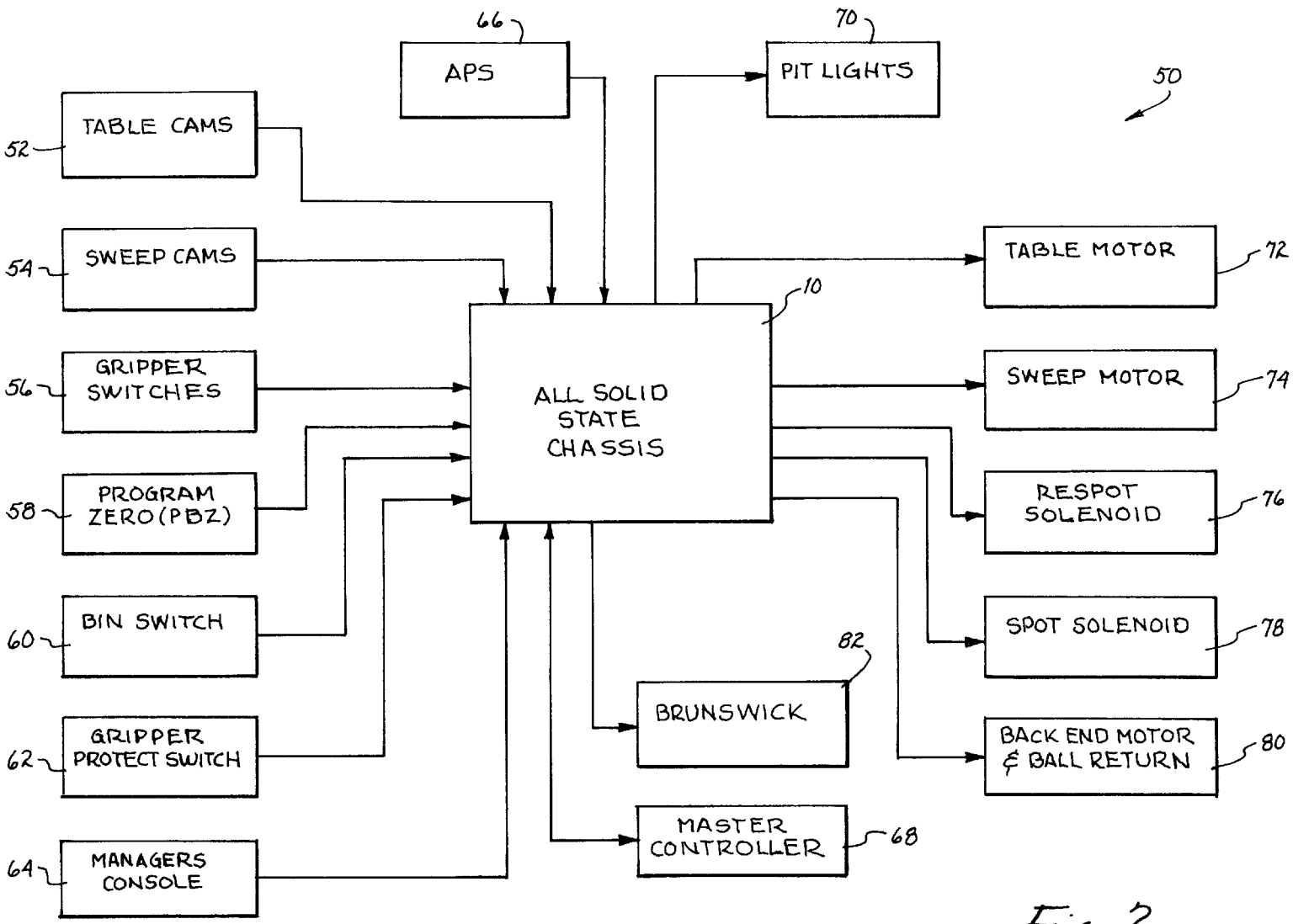
FIG. 2 is a simplified block diagram depicting those parts of the pinspotter that are directly associated with the solid state chassis of FIG. 1.
Figure 3:
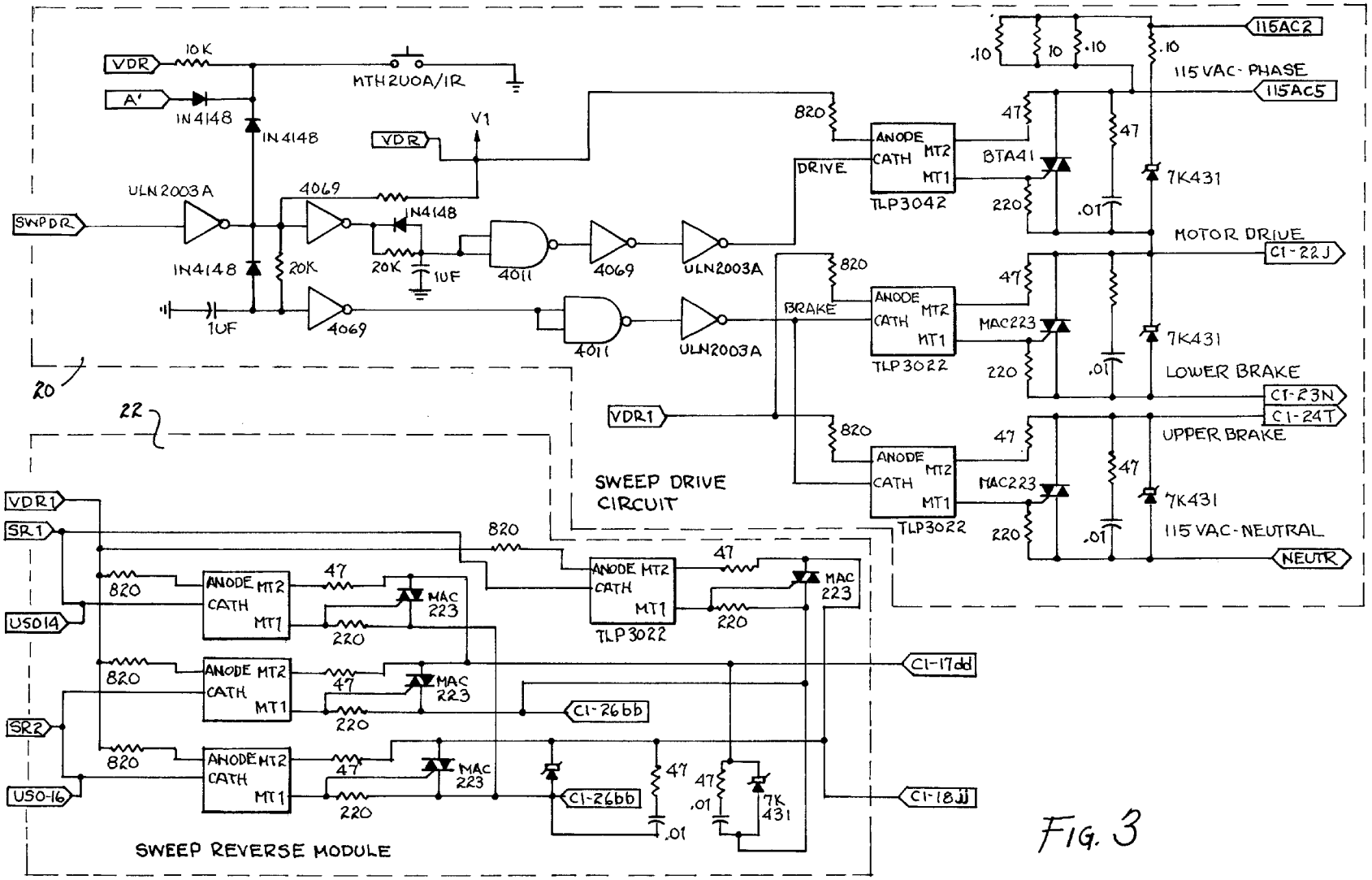
FIG. 3 is a detailed schematic of the sweep circuitry for the solid state chassis of FIG. 1.
Figure 4:
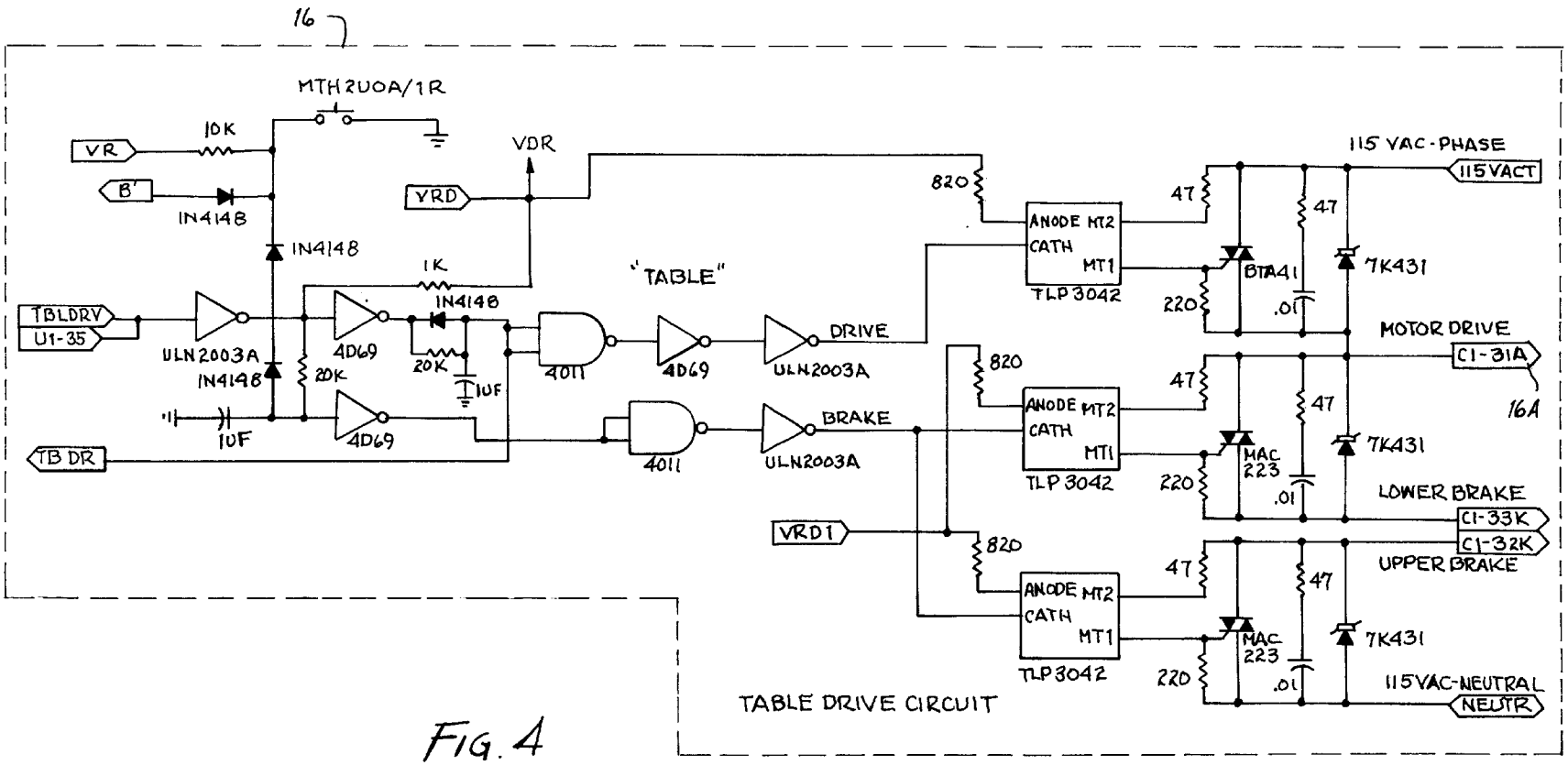
FIG. 4 is a detailed schematic of the table circuitry for the solid state chassis of FIG. 1.

Referring to FIG. 2, a block diagram of those elements of the pinspotter assembly that are directly associated with the chassis 10 is shown. FIG. 2 shows how the pinspotter assembly 50 connects to the chassis 10. Inputs to the chassis 10 include the table cams 52, the sweep cams 54, the gripper switches 56, the program zero switch (PBZ) 58, the bin switch 60, the gripper protect switch 62, the manager's console 64, the APS 66 and the master controller 68. The outputs to the chassis 10 include the pit lights 70, the table motor 72, the sweep motor 74, the respot solenoid 76, the spot solenoid 78, the back end motor and ball return 80, the Brunswick scoring system 82, and the master controller 68. In the present embodiment, the master controller 68 and the chassis 10 (designated as the ultra chassis) are two separate and distinct components. The two components are used in conjunction to provide :remote operation and control of the pinspotter assembly 50. One master controller 68 can control two ultra chassis. However, all of the remote functions of the master controller 68 could be inside of the ultra chassis.

Referring now to FIGS. 1–11*e,* wherein FIGS. 3–11*e* represent one embodiment of the actual circuitry used in the chassis 10, the operation of the chassis 10 will be discussed. It should be noted that in FIGS. 1–11*e* like numerals and symbols represent like elements.

The data and status of the pinspotter (not shown) is received by the optical inputs 14 of the chassis 10. The optical inputs 14 buffer and filter this data and present the data to the microcontroller 12 where the data is processed. Based on the inputs to the microcontroller 12, appropriate outputs are generated. These outputs are used to drive a plurality of motors and solenoids (not shown). Some of the outputs of the chassis 10 are as follows. The table drive circuit 16 (see FIG. 4) has an output 16A which is coupled to a motor drive (not shown) for moving a pinspotter table (not shown). The pinspotter table is moved in a vertical plane in order to pick up, place and spot the bowling pins. The sweep drive module (see FIG. 3) which comprises the sweep drive circuit 20 and the sweep reverse module 22 drives a sweep motor (not shown) to clear off the bowling pins so that either the pins still standing or a new set of pins can be placed on the pin deck.

Figure 5:
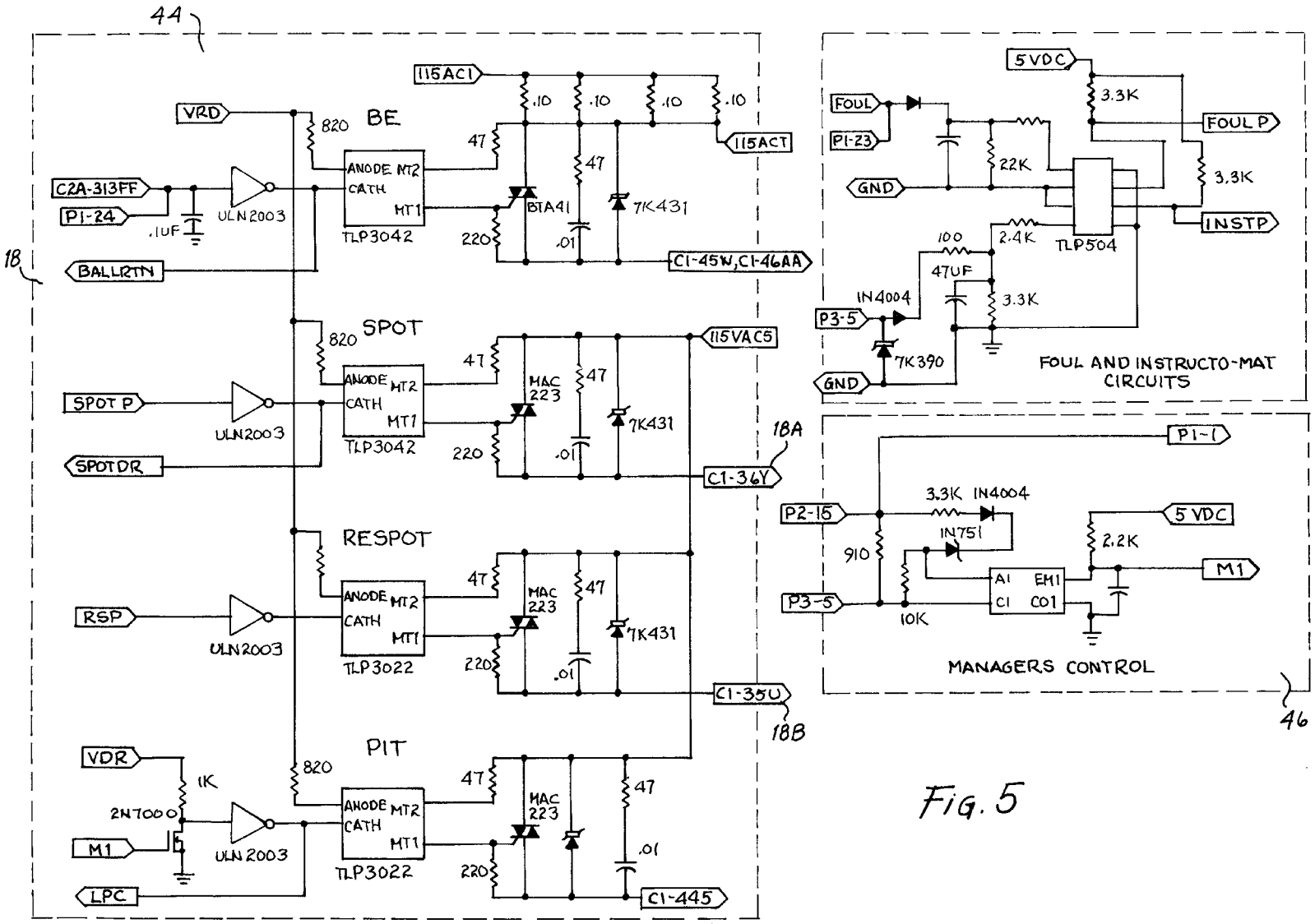
FIG. 5 is a detailed schematic of the high voltage output circuitry and the managers control circuitry for the solid state chassis of FIG. 1.

Referring to FIG. 5, a plurality of other output circuits are shown. The spot and respot control 18 has an output 18A which is coupled to a spot solenoid (not shown) and an output 18B coupled to a respot solenoid (not shown). When the spot solenoid is activated by the microcontroller 12, the downward travel of the pinspotter table is changed to a longer stroke thereby spotting a new set of pins. The respot solenoid is activated when the pinspotter table is running in a normal no spot cycle. Also shown in FIG. 5 is a ball return circuit 18. The ball return circuit 18 is coupled to a back end motor (not shown) which returns the bowling ball after it has been rolled down the bowling lane. The back end motor is also used to drive a pick up mechanism (not shown) which lifts the bowling pins up to a distributes mechanism (not shown).

Figure 6:
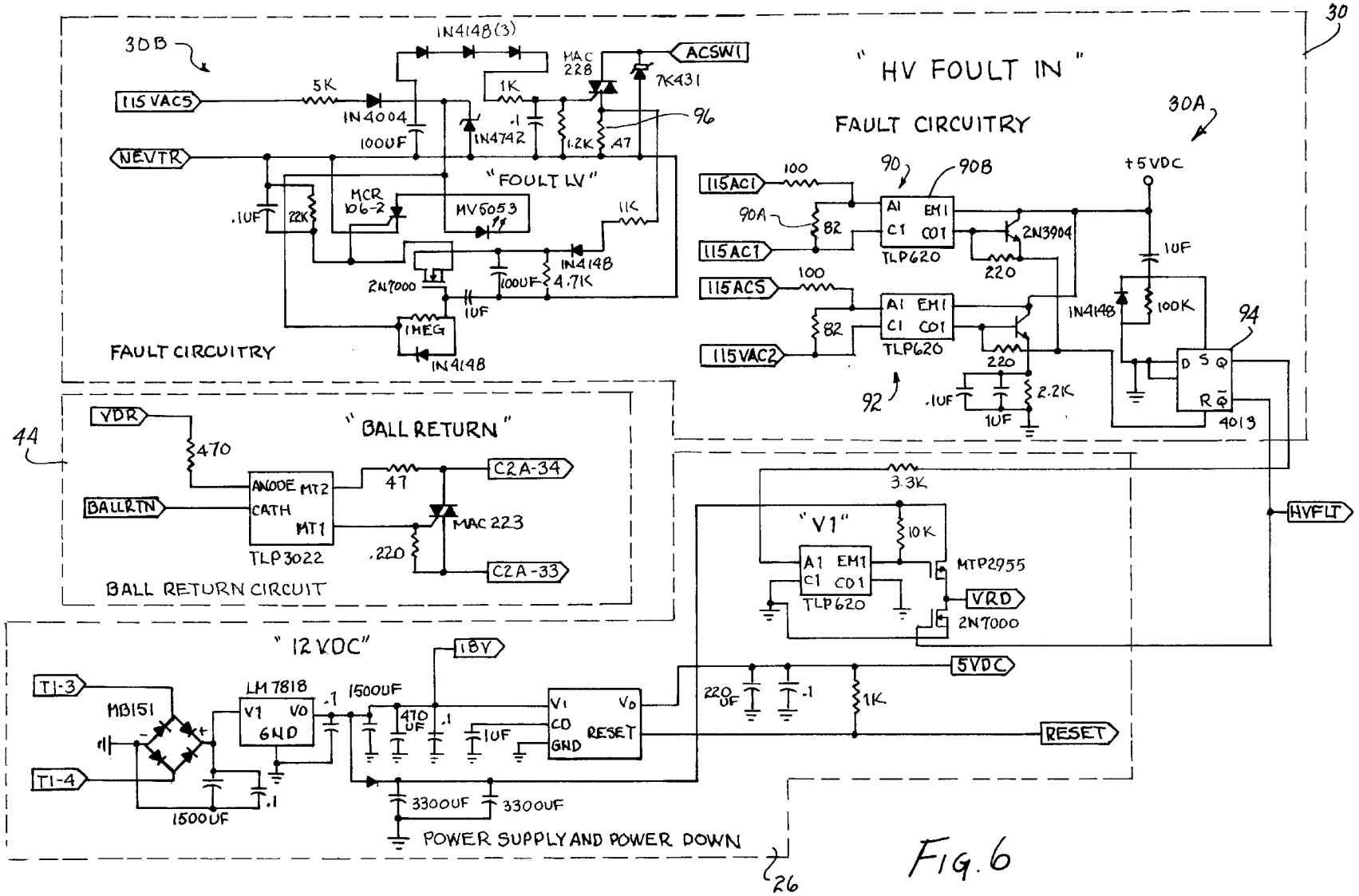
FIG. 6 is a detailed schematic of the low voltage and high voltage fault circuitry and the power supply circuitry for the solid state chassis of FIG. 1.
Figure 7:
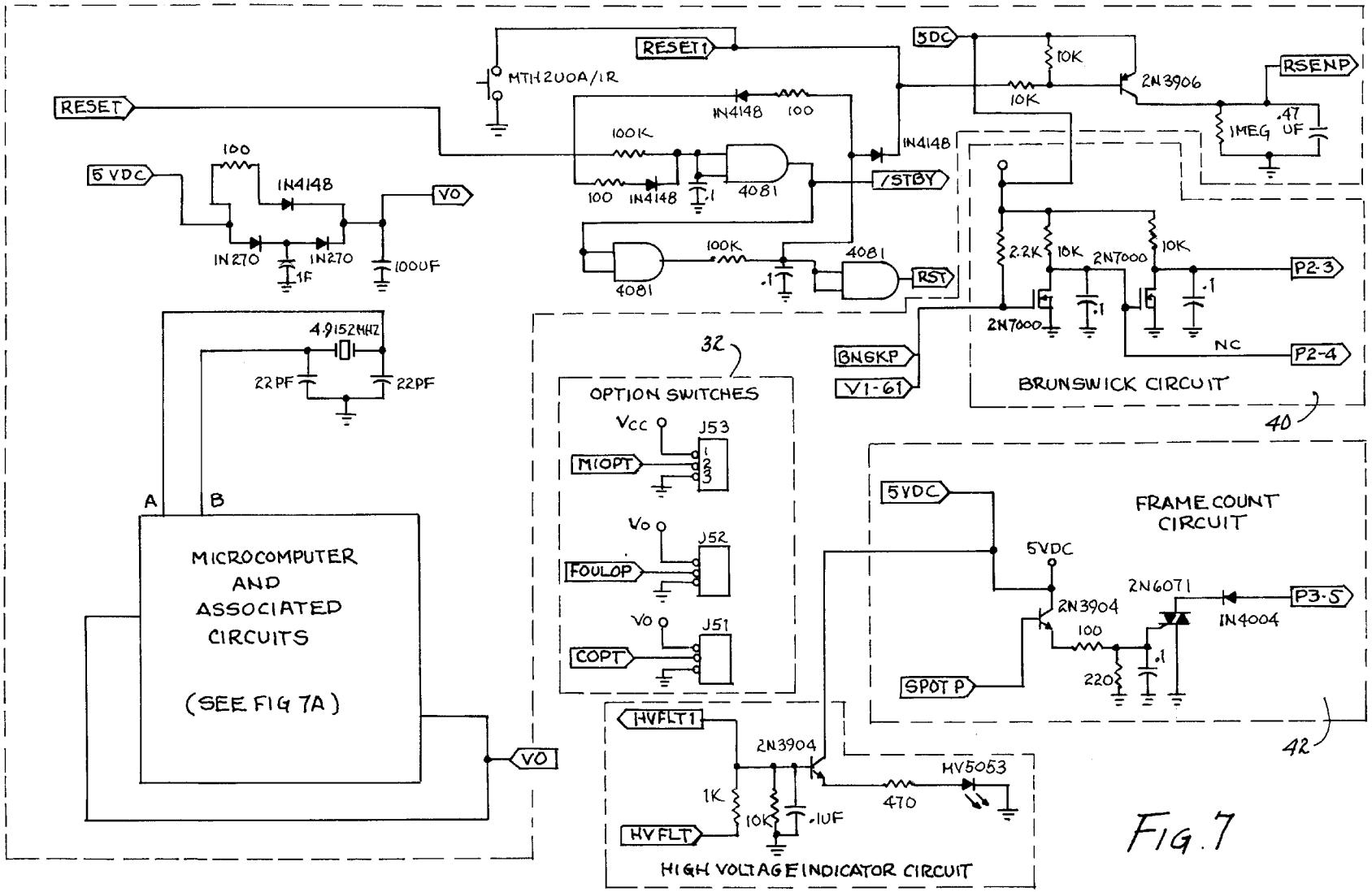
FIG. 7 is a detailed schematic of the microcontroller and its ancillary circuitry for the solid state chassis of FIG. 1.
Figure 7A:
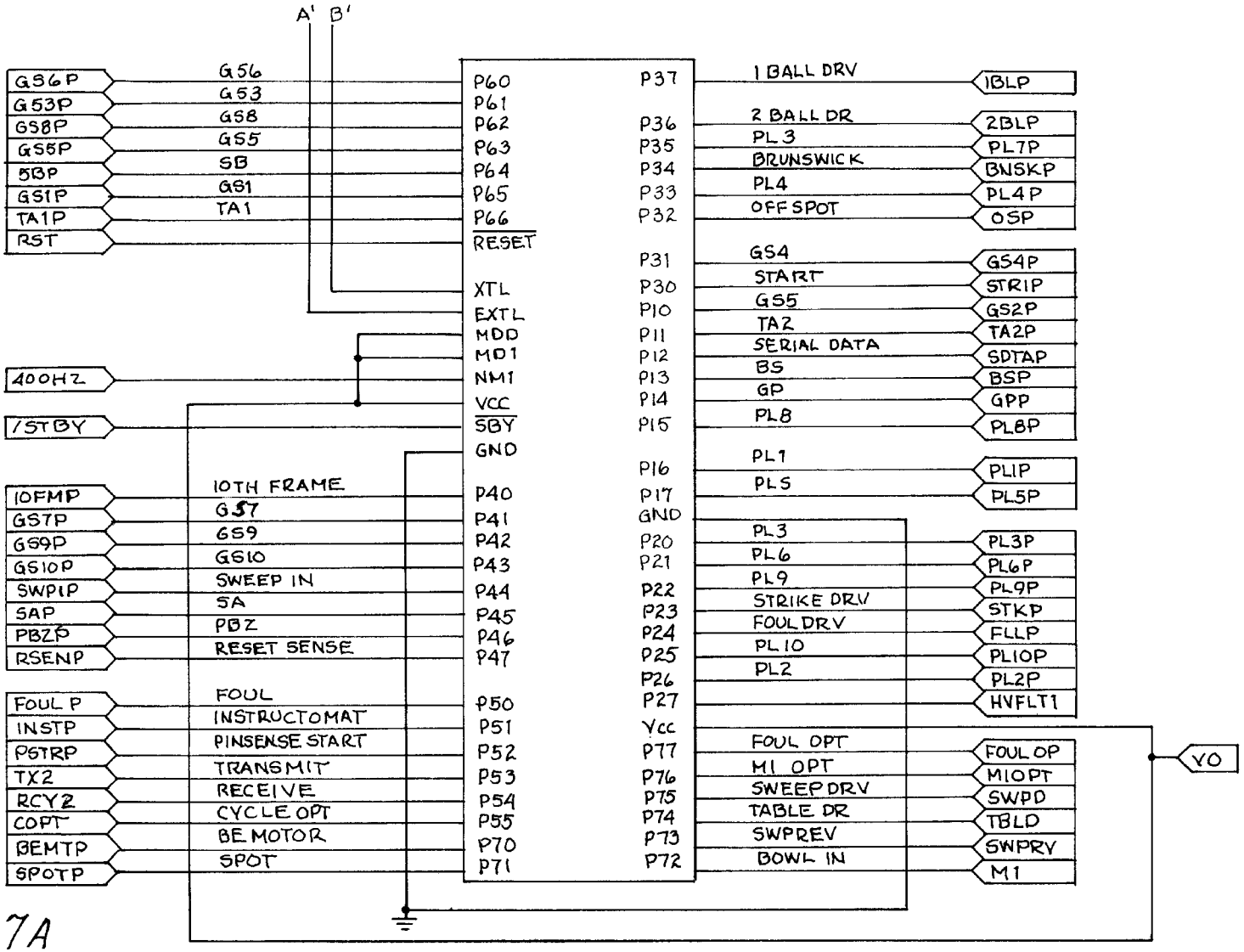
FIG. 7A is detailed schematic showing the pin layout of the microcontroller for the solid state chassis of FIG. 1.
Figure 8:
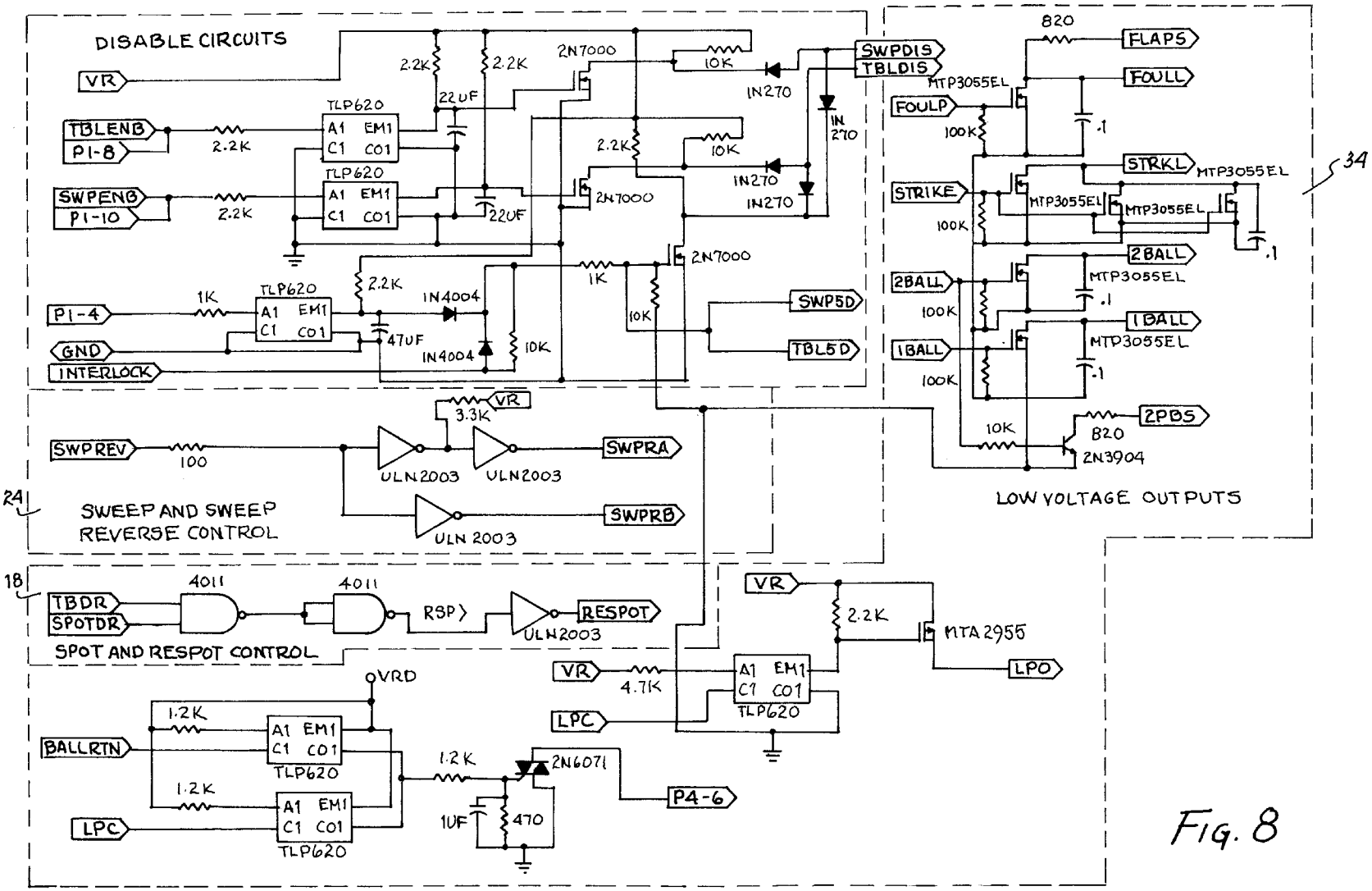
FIG. 8 is a detailed schematic of the control circuitry, some of the outputs for driving lights and the communication module for the solid state chassis of FIG. 1.
Figure 9:
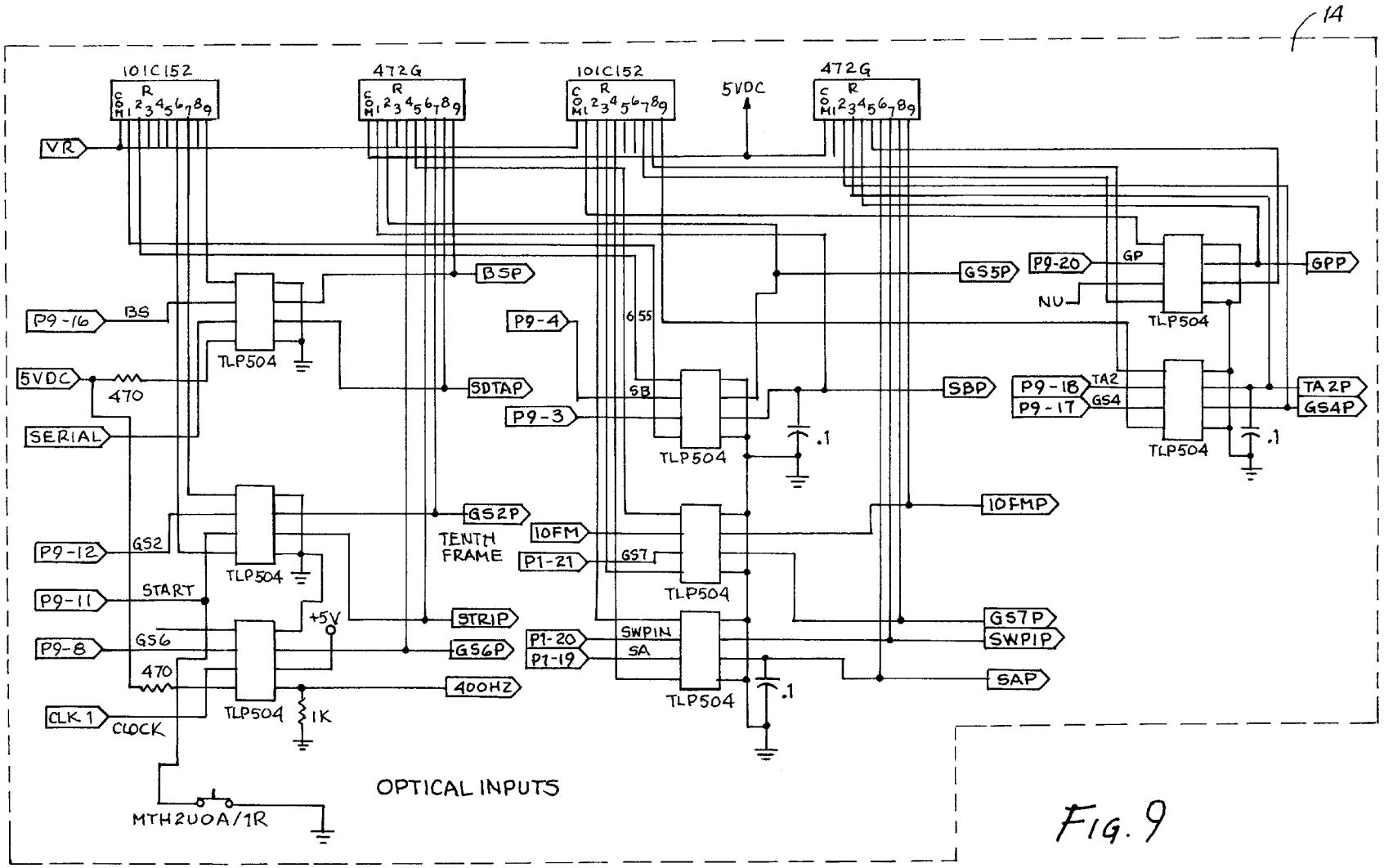
FIG. 9 is a detailed schematic of the optical inputs to the solid state chassis of FIG. 1.
Figure 10:
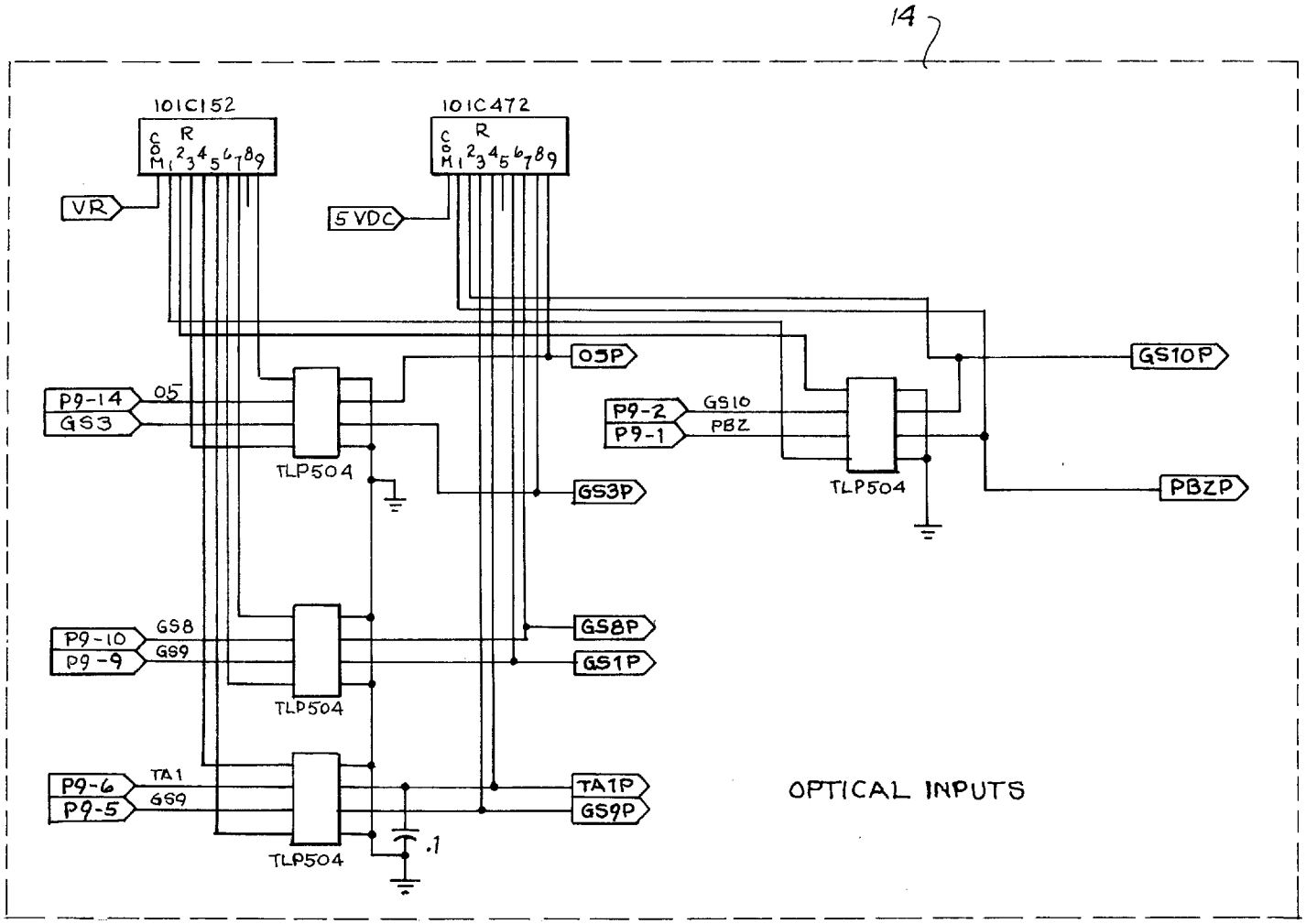
FIG. 10 is another detailed schematic of the optical inputs to the solid state chassis of FIG. 1.
Figures 11A, 11B, 11C, 11D, 11E:
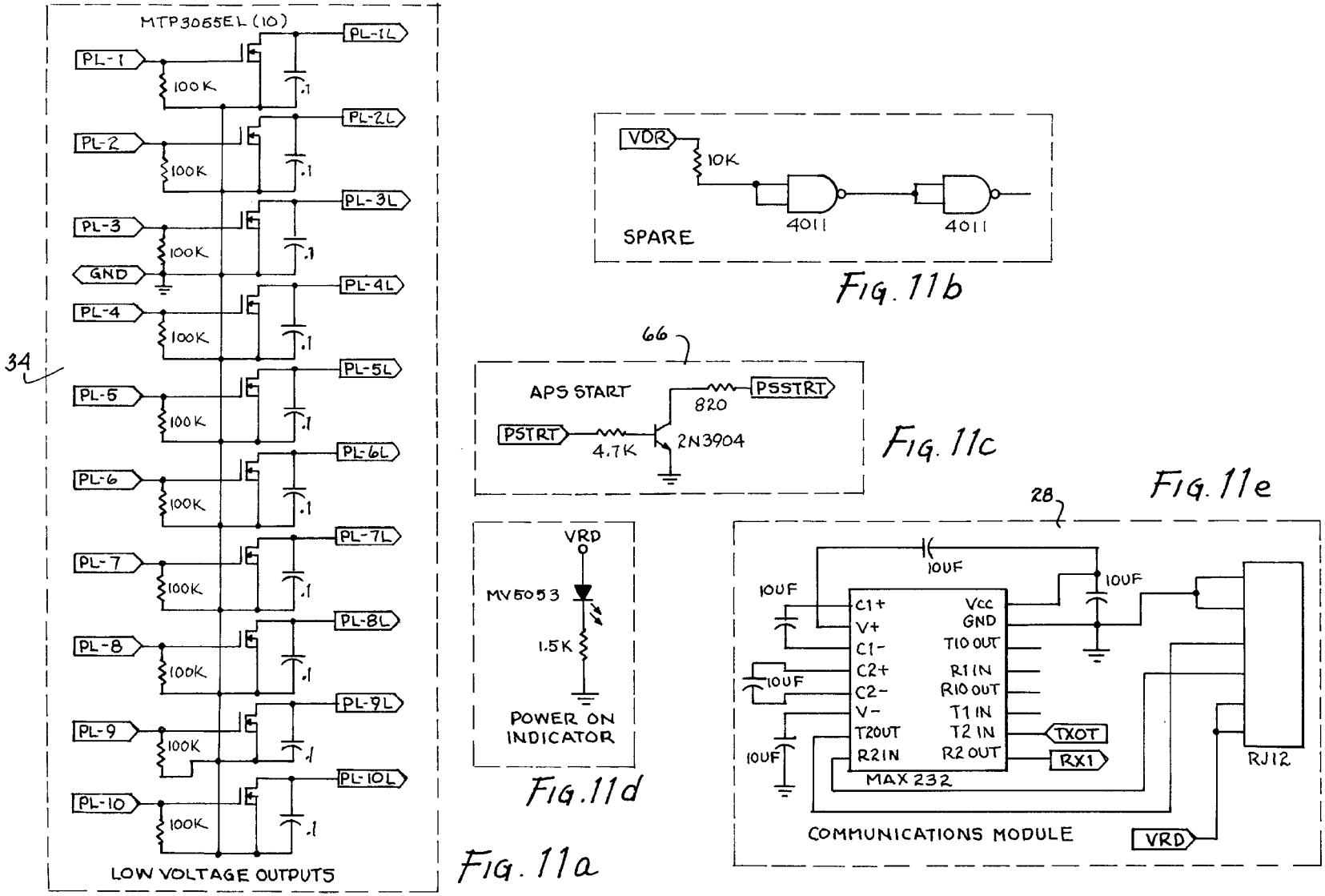
FIGS. 11*a–e* is a detailed schematic of the controls and miscellaneous circuitry for the solid state chassis of FIG. 1.

Referring to FIG. 6, the chassis 10 is protected against shorts and excessive current usage through the fault detection circuit 30. The fault detection circuit is comprised of a high voltage fault detection circuit 30A and a low voltage fault detection circuit 30B. The high voltage fault detection circuit 30A is comprised of two excessive current detectors. The two excessive current detectors 90, 92 are identical in nature except for the excessive current detection limit. In the preferred embodiment of the present invention, one excessive current detector 90 is set at 100 amperes, while a second excessive current detector 92 is set at 80 amperes. The high voltage fault detection circuit 30A operates as follows. A current through a small value high wattage resistor 90A develops a voltage that is coupled into a optical coupler 90A. When the amplitude of the input signal reaches approximately 1 volt, the optical coupler 90A output is turned on. This output is buffered and current amplified to produce a pulse that causes a device 94 to switch on thereby causing all power to the high voltage elements to be removed. Detection occurs in two milliseconds at 100 amperes. The low voltage fault detection circuit 30B operates in much the same way as the high voltage fault detection circuit 30B. The detection of a low voltage fault is accomplished on the primary side of the main transformer (not shown). Thus, all current consumed by the control electronics are monitored When the current becomes excessive, voltage is developed across a resistor 96 to cause a diode 98 to turn on thereby shutting down the chassis 10. Power must be turned off and then back on to clear any fault.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A solid state chassis for controlling a bowling pin pinspotter comprising, in combination:

microcontroller means for controlling said solid state chassis by receiving inputs from a plurality of elements coupled to said microcontroller means and for producing an output signal to control said solid state chassis based on said inputs;

optical input means coupled to said microcontroller means for buffering inputs to said microcontroller means to prevent noise associated with said plurality of elements from causing false outputs by said microcontroller means;

means coupled to said microcontroller means for sending a signal to a pinspotter assembly that controls placement of bowling pins;

sweep means coupled to said microcontroller means for sending a signal to a sweep type device that removes said bowling pins; and power supply/power down means coupled to said microcontroller means and said plurality of elements for providing power to said plurality of elements and for detecting and controlling said solid state chassis during a power failure.

2. A solid state chassis in accordance with claim 1 further comprising back end motor means coupled to said microcontroller means for moving said bowling pins to a distributor mechanism after said sweep means have removed said bowling pins, said back end motor means having means for generating a breaking signal which conserves power by deactivating said back end motor means when said sweep means are not active and for reinitiating said back end motor means after a bowling ball has been rolled.

3. A solid state chassis in accordance with claim 1 wherein said power supply/power down means allows said microcontroller means to remember status and position of said solid state chassis and placement of said bowling pins when a power failure occurs.

4. A solid state chassis in accordance with claim 1 further comprising communication means coupled to said microcontroller means for sending and receiving data to and from said solid state chassis from a remote location.

5. A solid state chassis in accordance with claim 1 further comprising fault protection means coupled to said microcontroller means for detecting excessive current use by said solid state chassis and for protecting said solid state chassis from said excessive current.

6. A solid state chassis in accordance with claim 1 further comprising option switch means coupled to said microcontroller means for allowing a selection of an operating cycle for said solid state chassis.

7. A solid state chassis in accordance with claim 6 wherein said operating cycle comprises one of a no foul cycle, a cycle from a manager's console, bowling league practice cycle; an eliminate manual intervention cycle, and a turn off back end motor due to inactivity cycle.

8. A solid state chassis in accordance with claim 1 further comprising:

first voltage output means coupled to said microcontroller means for providing power to a plurality of lights for indicating status of said solid state chassis; and second voltage output means coupled to said microcontroller means for providing power to a plurality of motors for operating said pinspotter assembly.

9. A solid state chassis in accordance with claim 8 further comprising:

first fault detection means for providing short circuit and overload protection for elements of said solid state chassis powered by said first voltage output means; and second fault detection means for providing short circuit and overload protection for high voltage elements of said solid state chassis powered by said second voltage output means.

10. A solid state chassis in accordance with claim 9 wherein said first fault detection means comprises:

diode means for turning off power to said elements of said solid state chassis powered by said first voltage output means when current to any of said elements powered by said first voltage output means is above a maximum operating level; and resistor means for generating a voltage to turn on said diode means when a operating current of any of said elements powered by said first voltage output means is above said maximum operating level.

11. A solid state chassis in accordance with claim 9 wherein said second fault detection means comprises:

means for turning off power to said elements of said solid state chassis powered by said second voltage output means when current to any of said elements powered by said second voltage output means is above a maximum operating level;

first excessive current detector means coupled to said means for turning off power to said elements powered by said second voltage output means for detecting operating currents for said elements powered by said second voltage output means in excess of a first excessive current level; and second excessive current detector means coupled to said means for turning off power to said elements powered by said second voltage output means for detecting operating currents in excess of a second excessive current level.

12. A solid state chassis in accordance with claim 1 further comprising disabling means coupled to said microcontroller means for controlling power distribution to said solid state chassis and said pinspotter assembly.

13. A solid state chassis in accordance with claim 1 further comprising interface means coupled to said microcontroller means for allowing said solid chassis to communicate with a BRUNSWICK scoring system.

14. A solid state chassis for controlling a bowling pin pinspotter comprising, in combination:

microcontroller means for controlling said solid state chassis by receiving inputs from a plurality of elements coupled to said microcontroller means and producing an output signal to control said solid state chassis based on said inputs;

optical input means coupled to said microcontroller means for buffering inputs to said microcontroller means to prevent noise associated with said plurality of elements from causing false outputs by said microcontroller means;

means coupled to said microcontroller means for sending a signal to a pinspotter assembly that controls placement of bowling pins;

sweep means coupled to said microcontroller means for sending a signal to a sweep type device that removes said bowling pins;

power supply/power down means coupled to said microcontroller means and said plurality of elements for providing power to said plurality of elements, for detecting and controlling said solid state chassis during a power failure, and for allowing said microcontroller means to remember status and position of said solid state chassis and placement of said bowling pins when a power failure occurs;

back end motor means coupled to said microcontroller means for moving said bowling pins to a distributor mechanism after said sweep means have removed said bowling pins, said back end motor means having means for generating a breaking signal which conserves power by deactivating said back end motor means when said sweep means are not active and for reinitiating said back end motor means after a bowling ball has been rolled;

first voltage output means coupled to said microcontroller means for providing power to a plurality of lights for indicating status of said solid state chassis;

second voltage output means coupled to said microcontroller means for providing power to a plurality of motors for operating said pinspotter assembly;

fault protection means coupled to said microcontroller means for detecting excessive current use by said solid state chassis and for protecting said solid state chassis from said excessive current, said fault protection means comprising:

first fault detection means for providing short circuit and overload protection for elements of said solid state chassis powered by said first voltage output means; and second fault detection means for providing short circuit and overload protection for elements of said solid state chassis powered by said second voltage output means;

communication means coupled to said microcontroller means for sending and receiving data to and from said solid state chassis from a remote location;

option switch means coupled to said microcontroller means for allowing a selection of an operating cycle for said solid state chassis; said operating cycle comprises one of a no foul cycle, a cycle from a manager's console, an eliminate bowling league practice cycle; an eliminate manual intervention cycle, and a turn off back end motor due to inactivity cycle; and disabling means coupled to said microcontroller means for controlling power distribution to said solid state chassis and said pinspotter assembly.

15. A solid state chassis in accordance with claim 14 wherein said first fault detection means comprises:

diode means for turning off power to said elements of said solid state chassis powered by said first voltage output means when current to any of said elements powered by said first voltage output means is above a maximum operating level; and resistor means for generating a voltage to turn on said diode means when a operating current of any of said elements powered by said first voltage output means is above a maximum operating.

16. A solid state chassis in accordance with claim 14 wherein said second fault detection means comprises:

means for turning off power to said elements of said solid state chassis powered by said second voltage output means when current to any of said elements powered by said second voltage output means is above a maximum operating level;

first excessive current detector means coupled to said means for turning off power to said elements powered by said second voltage output means for detecting operating currents for said elements powered by said second voltage output means in excess of a first excessive current level; and second excessive current detector means coupled to said means for turning off power to said elements powered by said second voltage output means for detecting operating currents in excess of a second excessive current level.

17. A method of providing a solid state chassis for controlling a bowling pin pinspotter comprising the steps of:

providing microcontroller means for controlling said solid state chassis by receiving inputs from a plurality of elements coupled to said microcontroller means and for producing an output signal to control said solid state chassis based on said inputs;

providing optical input means coupled to said microcontroller means for buffering inputs to said microcontroller means to prevent noise associated with said plurality of elements from causing false outputs by said microcontroller means;

providing means coupled to said microcontroller means for sending a signal to a pinspotter assembly that controls placement of bowling pins;

providing sweep means coupled to said microcontroller means for sending a signal to a sweep type device that removes said bowling pins; and providing power supply/power down means coupled to said microcontroller means and said plurality of elements for providing power to said plurality of elements, for detecting and controlling said solid state chassis during a power failure, and for allowing said microcontroller means to remember a status and a position of said solid state chassis and placement of said bowling pins when a power failure occurs.

18. The method of claim 17 further comprising the said step of:

providing back end motor means coupled to said microcontroller means for moving said bowling pins to a distributor mechanism after said sweep means have removed said bowling pins, said back end motor means having means for generating a breaking signal which conserves power by deactivating said back end motor means when said sweep means are not active and for reinitiating said back end motor means after a bowling ball has been rolled;

providing fault protection means coupled to said microcontroller means for detecting excessive current use by said solid state chassis and for protecting said solid state chassis from said excessive current;

providing communication means coupled to said microcontroller means for sending and receiving data to and from said solid state chassis from a remote location;

providing option switch means coupled to said microcontroller means for allowing a selection of an operating cycle for said solid state chassis, said operating cycle comprising one of a no foul cycle, a cycle from a manager's console, an eliminate bowling league practice cycle; an eliminate manual intervention cycle, and a turn off back end motor due to inactivity cycle;

providing first voltage output means coupled to said microcontroller means for providing power to a plurality of lights for indicating status of said solid state chassis;

providing second voltage output means coupled to said microcontroller means for providing power to a plurality of motors for operating said pinspotter assembly; and providing disabling means coupled to said microcontroller means for controlling power distribution to said solid state chassis and said pinspotter assembly.

19. The method of claim 17 wherein said step of providing fault protection means further comprises the step of providing first fault detection means for providing short circuit and overload protection for elements of said solid state chassis powered by said first voltage output means, said first fault detection means comprising:

diode means for turning off power to said elements of said solid state chassis powered by said first voltage output means when current to any of said elements powered by said first voltage output means is above a maximum operating level; and resistor means for generating a voltage to turn on said diode means when a operating current of any of said elements powered by said first voltage output means is above a maximum operating.

20. The method of claim 17 wherein said step of providing fault protection means further comprises the step of providing second fault detection means for providing short circuit and overload protection for elements of said solid state chassis powered by said second voltage output means, said high voltage fault detection means comprising:

means for turning off power to said elements of said solid state chassis powered by said second voltage output means when current to any of said elements powered by said second voltage output means is above a maximum operating level;

first excessive current detector means coupled to said means for turning off power to said elements powered by said second voltage output means for detecting operating currents for said elements powered by said second voltage output means in excess of a first excessive current level; and second excessive current detector means coupled to said means for turning off power to said elements powered by said second voltage output means for detecting operating currents in excess of a second excessive current level.

* * * * *